US009441438B2

(12) United States Patent
Allison et al.

(10) Patent No.: US 9,441,438 B2
(45) Date of Patent: Sep. 13, 2016

(54) PERFORATING GUN ASSEMBLY AND METHOD OF FORMING WELLBORE PERFORATIONS

(71) Applicant: DELPHIAN TECHNOLOGIES LIMITED, Aberdeen (GB)

(72) Inventors: Simon Douglas Eardly Allison, Aberdeen (GB); Jörn Olaf Löhken, Troisdorf (DE); Liam McNelis, Bonn (DE)

(73) Assignee: DELPHIAN BALLISTICS LIMITED, Edinburgh (GB)

( * ) Notice: Subject to any disclaimer, the term of this patent is extended or adjusted under 35 U.S.C. 154(b) by 0 days.

(21) Appl. No.: 14/323,505

(22) Filed: Jul. 3, 2014

(65) Prior Publication Data

US 2015/0368996 A1 Dec. 24, 2015

(30) Foreign Application Priority Data

Jun. 20, 2014 (GB) ..... 1411080.3
Jul. 2, 2014 (GB) ..... 1411841.8

(51) Int. Cl.

| | |
|---|---|
| ***E21B 43/11*** | (2006.01) |
| ***E21B 29/02*** | (2006.01) |
| ***E21B 43/117*** | (2006.01) |
| ***E21B 43/119*** | (2006.01) |

(52) U.S. Cl.

CPC ..... *E21B 29/02* (2013.01); *E21B 43/117* (2013.01); *E21B 43/119* (2013.01)

(58) Field of Classification Search

CPC ..... E21B 43/117; E21B 43/119; E21B 43/26
See application file for complete search history.

(56) References Cited

U.S. PATENT DOCUMENTS

| | | | | |
|---|---|---|---|---|
| 3,089,416 | A * | 5/1963 | Gilbert | 175/4.6 |
| 3,241,488 | A * | 3/1966 | Glass | 102/310 |
| 3,347,314 | A | 10/1967 | Schuster | |
| 4,047,569 | A * | 9/1977 | Tagirov et al. | 166/308.1 |
| 4,756,371 | A * | 7/1988 | Brieger | 166/312 |
| 5,673,760 | A * | 10/1997 | Brooks et al. | 175/4.6 |
| 7,172,023 | B2 * | 2/2007 | Barker et al. | 166/297 |
| 7,303,017 | B2 | 12/2007 | Barker et al. | |
| 7,409,992 | B2 * | 8/2008 | Zazovsky et al. | 166/297 |
| 7,913,758 | B2 * | 3/2011 | Wheller et al. | 166/259 |
| 8,327,746 | B2 * | 12/2012 | Behrmann et al. | 89/1.15 |
| 8,919,443 | B2 * | 12/2014 | Parker et al. | 166/297 |
| 9,038,521 | B1 * | 5/2015 | Rollins et al. | 89/1.151 |
| 2003/0188867 | A1 * | 10/2003 | Parrott et al. | 166/297 |
| 2005/0167108 | A1 * | 8/2005 | Chang et al. | 166/298 |
| 2005/0194146 | A1 * | 9/2005 | Barker et al. | 166/298 |
| 2005/0194181 | A1 * | 9/2005 | Barker et al. | 175/4.55 |
| 2005/0211467 | A1 * | 9/2005 | Ratanasirigulchia et al. | 175/4.5 |
| 2005/0247447 | A1 | 11/2005 | Spring et al. | |

(Continued)

OTHER PUBLICATIONS

Nov. 16, 2015 International Search Report and Written Opinion issued in PCT Application No. PCT/GB2015/051761.

*Primary Examiner* — Jennifer H Gay
(74) *Attorney, Agent, or Firm* — Nixon & Vanderhye P.C.

(57) ABSTRACT

A perforating gun assembly used to form perforations in a wellbore includes a charge carrier having a longitudinal axis, and multiple groups of shaped charges that are disposed on the charge carrier. Two or more of the shaped charges within each group are arranged to generate jets oriented substantially along respective axes that converge towards one another. Also, two or more of the groups of shaped charges overlap one another in a longitudinal direction of the charge carrier.

31 Claims, 6 Drawing Sheets

(56) References Cited

U.S. PATENT DOCUMENTS

2006/0289167 A1* 12/2006 Surjaatmadja et al. ... 166/308.1
2007/0158109 A1* 7/2007 Zazovsky et al. ..... 175/4.6
2009/0166040 A1* 7/2009 Cavender et al. ..... 166/281
2010/0269676 A1* 10/2010 Behrmann et al. ..... 89/1.15
2013/0032347 A1* 2/2013 Parker et al. ..... 166/285
2013/0180701 A1* 7/2013 Clay et al. ..... 166/55
2014/0262232 A1* 9/2014 Dusterhoft et al. ..... 166/250.1
2015/0226043 A1* 8/2015 Hardesty et al. ..... 43/117
2015/0267516 A1 9/2015 Hardesty et al.

* cited by examiner

PERFORATING GUN ASSEMBLY AND METHOD OF FORMING WELLBORE PERFORATIONS

The present invention relates to a perforating gun assembly and a method of forming wellbore perforations. In one aspect, the invention relates to a perforation gun assembly comprising convergent shaped charge orientations and a method of use.

BACKGROUND TO THE INVENTION

In the hydrocarbon exploration and production industry, it is common to use perforating guns to form fluid communication paths ("perforations") in a subterranean formation between a hydrocarbon reservoir and a drilled wellbore that traverses the reservoir. The communication paths enable the inflow of production fluids into the wellbore, and enable the delivery of stimulation fluids to the formation, for example during hydraulic fracturing operations. Typically perforation methods are applied to cased hole wellbores, which include a casing string cemented within the wellbore to increase the integrity of the wellbore and provide a flow path to surface for fluids produced from the formation. The perforations extend through the steel casing, the cement on the outside of the casing, and into the formation. Similar methods are used in the fields of water and geothermal exploration.

It is conventional to form the perforations by placing a perforating gun which incorporates shaped charges inside the casing string next to the formation to be perforated. A typical perforation gun comprises a charge carrier and a series of shaped charges connected to a detonator by a detonation cord. The perforation gun forms a part of a tool string which is conveyed into the wellbore by a flexible line, drill string, coiled tubing, or other conveyance. Commonly, flexible line such as wireline, electric line or slickline is used to convey the perforating gun to the required depth.

With the charge carriers located in the interval to be perforated, the shaped charges are detonated to generate high-pressure streams of particles in the form of jets. The jets penetrate through the casing, the cement and into the formation.

Challenges associated with the successful design and operation of perforation guns include gun survivability during the perforating operation, and the effectiveness of perforations during hydrocarbon production or stimulation operations.

Gun survivability concerns the capability of the gun to retain its mechanical integrity during and after detonation of the shaped charges such that it can be successfully retrieved from the wellbore without damaging the casing or causing debris to left downhole. The survival risk associated with a perforation gun is dependent on a number of different factors, including the magnitude of the shaped charges, the design and materials of the charge carrier and tool string, the phasing of the shaped charges, or their proximity (or shot density). Where perforation in a single or narrow phasing plane is desirable, as may be the case in sand control or hydraulic fracturing applications, it is common to account for increased survival risk by increasing the shot-to-shot spacing, increasing the mechanical rating of the perforating gun (for example by specifying high grade or high integrity materials) or reducing the shaped charge explosive capacity. Undesirable compromises of these factors may include a reduction in perforation density, increased tool cost, and/or a reduction in perforation penetration depth.

U.S. Pat. No. 5,673,760 describes a configuration which is said to reduce gun survival risk by arranging groups of charges in the same cylindrical plane and closely packing the charges. Charges within a group are detonated symmetrically. This system is claimed to reduce gun swelling and reduce the amount of debris that escapes the perforating gun.

Various factors contribute to the effect of the perforations on the productivity of the well or the success of a fracturing operation. These include depth and effective diameter of perforation tunnels. The pressure condition within the wellbore during the perforation process also has a significant impact on the efficiency of the perforations.

The perforation is formed in an overbalanced pressure regime if the hydrostatic pressure inside the casing is greater than the reservoir pressure. Perforating underbalanced is when the perforation is formed under conditions in which the hydrostatic pressure inside the casing is less than the reservoir pressure. Underbalanced perforating has the tendency to allow the reservoir fluid to flow into the wellbore, and is generally preferable as the influx of reservoir fluid into the wellbore tends to clean up the perforation tunnels and increase the depth of the clear tunnel of the perforation.

It has been found, however, that even when perforating is performed underbalanced, the effective diameter of the perforation tunnels can be small as the jet of metallic particles that creates the perforation tunnels is highly concentrated. Due to the small diameter of the perforation tunnels, the volume of the perforation tunnels is also small. In addition, it has been found that even when perforating is performed underbalanced, the surface of the perforation tunnels may have reduced permeability compared to the virgin rock.

One technique for generating perforations with improved inflow characteristics is to use groups or banks of convergent or focused shaped charges. U.S. Pat. No. 3,347,314, U.S. Pat. No. 7,303,017, U.S. Pat. No. 7,172,023 and U.S. Pat. No. 7,409,992 are examples of perforation devices which used convergent charge groups to create an enhanced perforation cavity. The cavities formed are said to be of relatively large volume with high permeability to enhance productivity.

Disadvantages of convergent charge configurations of the types described in U.S. Pat. No. 3,347,314, U.S. Pat. No. 7,303,017, U.S. Pat. No. 7,172,023 and U.S. Pat. No. 7,409,992 result from the requirement for the shaped charges to operate in functional groups. This places restrictions on shaped charge placement and phasing, which can have an adverse effect on production flow geometry in a radial direction around the wellbore. It may be desirable for the convergent charges within a group to be closely spaced to one another for proper interaction of the jets generated by the convergent charges, but gun survivability issues require compromises in shot density, charge capacity or increased material costs in order to reduce the survival risk.

SUMMARY OF THE INVENTION

There is generally a need for a perforating gun assembly and method of use which addresses one or more of the problems identified above. It is therefore amongst the aims and objects of the invention to provide a perforating gun assembly and method of use which obviates or mitigates one or more drawbacks or disadvantages of the prior art.

A further aim and object of the invention is to provide perforating gun assembly which is an alternative to the perforating gun assemblies of the prior art, and a method of use.

In particular, one aim of an aspect of the invention is to provide a perforating gun assembly comprising an arrangement of convergent shaped charges which mitigates one or more disadvantages of known devices, for example with regard to gun survivability, charge capacity, and/or manufacturing costs. Further aims of the invention are to provide a perforating gun assembly which forms perforations with an improved inflow and/or fracture initiation geometry.

Additional aims and objects of the invention will become apparent from reading the following description.

According to a first aspect of the invention, there is provided a perforating gun assembly comprising:

a charge carrier having a longitudinal axis;

a plurality of groups of shaped charges disposed on the charge carrier, wherein at least two shaped charges within each group are arranged to generate jets oriented substantially along respective axes that converge towards one another;

wherein at least two groups of shaped charges overlap one another in a longitudinal direction of the charge carrier.

The at least two groups of shaped charges may be intermeshed or interlaced in a longitudinal direction of the charge carrier.

The assembly may comprise a first group of shaped charges comprising charges arranged over a first axial portion of the charge carrier;

and a second group of charges comprising charges arranged over a second axial portion of the charge carrier;

wherein the first and second axial portions overlap in a longitudinal direction of the charge carrier.

The assembly may comprise three, four, or more groups of shaped charges.

A group of shaped charges may comprise two, three, four or more shaped charges. Each group may comprise three or more shaped charges. Each group may comprise the same number of shaped charges, or alternatively groups may comprise different numbers of shaped charges.

The assembly may comprise at least two groups of shaped charges rotationally offset or phased around the longitudinal axis of the charge carrier.

One or more groups of shaped charges may be arranged in a line parallel to the longitudinal axis of the charge carrier. Preferably each group of shaped charges is arranged in a line parallel to the longitudinal axis of the charge carrier.

The assembly may comprise a collection of shaped charges of the perforating gun assembly. The collection may comprise N groups of shaped charges arranged to generate jets oriented substantially along respective axes that converge towards one another and create perforations which interact to form N perforation channels. The N perforation channels may comprise at least two perforation channels that overlap one another in a longitudinal direction of the wellbore.

The overlapping shaped charge groups may be intersected by a plane perpendicular to the longitudinal direction of the charge carrier. Therefore a plane which traverses the charge carrier may extend through the overlapping shaped charge groups.

The N groups of shaped charges in a collection may be rotationally offset or phased around the longitudinal axis of the charge carrier by 360/N degrees.

In one example, the assembly comprises first and second groups of shaped charges to form first and second perforation channels which overlap one another and are rotationally offset by 180 degrees. In this example, the first and second perforation channels may have first and second major diameters oriented substantially in the same plane. Such a configuration may be preferred in some hydraulic fracturing applications.

In another example, the assembly comprises a collection comprising first and second groups of shaped charges to form first and second perforation channels which overlap one another and are rotationally offset by 90 degrees. Such a configuration may be preferred for optimising production.

Using convergent shaped charges which overlap one another has the unexpected benefit of significantly reducing a geometrical flow resistance which may be manifested in conventional convergent charge perforation methodologies. For example, with the perforating systems described in U.S. Pat. No. 7,303,017, U.S. Pat. No. 7,172,023, the relatively large spacing required between the adjacent charge groups limits the shot density, and thus reduces the axial spacing of perforation channels compared with conventional perforating gun assemblies. This prior art arrangement can result in production flow convergence and lower the connected drawdown radius, which has an adverse effect on production flow.

The assembly of the invention also has benefits in hydraulic fracturing applications. The perforation channels formed by the inventive assembly are more closely aligned which aids fracture growth and placement control, as fracture initiation points are positioned axially close to one another.

An additional unexpected benefit is an improved gun survivability as a result of the overlapping, and optional phasing, of groups of convergent shaped charges. The intermeshing of charges promotes the distribution and dissipation of shock wave forces through the perforating gun assembly, and increases the integrity of the perforating gun assembly and tool string without compromises regarding charge placement, charge capacity, or material and manufacturing costs.

The perforating gun assembly may comprise a plurality of collections of shaped charges, each collection comprising a plurality of groups of shaped charges disposed on the charge carrier, wherein at least two shaped charges within each group are arranged to generate jets oriented substantially along respective axes that converge towards one another. Each may comprise at least two groups of shaped charges that overlap one another in a longitudinal direction of the charge carrier.

The plurality of collections of shaped charges may be axially distributed along the charge carrier, and may be axially separated along the charge carrier.

Preferably the collections of shaped charges are rotationally offset or phased around the longitudinal axis of the charge carrier.

Where the assembly comprises a collection of at least two groups of shaped charges rotationally offset or phased around the longitudinal axis of the charge carrier by an angle $\theta_1$, the collections of shaped charges may be rotationally offset or phased around the longitudinal axis of the charge carrier by an angle $\theta_2$. Angle $\theta_1$ may be different from an angle $\theta_2$.

Angles of phasing between groups of charges in collections include but are not limited to 15 degrees, 30 degrees, 45 degrees, 60 degrees, 90 degrees, 135 degrees and 180 degrees.

Example angles of phasing between collections of charges include but are not limited to 15 degrees, 30 degrees, 45 degrees, 60 degrees, 90 degrees, 135 degrees and 180 degrees.

Angle $\theta_1$ may be greater than angle θ2. In one example, the assembly comprises a first collection of at least two groups of shaped charges rotationally offset or phased around the longitudinal axis of the charge carrier by an angle of 180 degrees within a collection, and a second collection of shaped charges may be rotationally offset or phased around the longitudinal axis of the charge carrier by an angle of less than 180 degrees. In another example, the assembly comprises a first collection of at least two groups of shaped charges rotationally offset or phased around the longitudinal axis of the charge carrier by an angle of 90 degrees within a collection, a second collection of shaped charges may be rotationally offset or phased around the longitudinal axis of the charge carrier by an angle of less than 90 degrees (for example 60 degrees).

Angle $\theta_1$ may be the same for each of multiple collections of shaped charges (i.e. in every collection, the phasing angle between groups may be the same). Alternatively, angle $\theta_1$ may differ from one collection of shaped charges to another.

Angle $\theta_2$ may be the same for each of multiple collections of shaped charges, (i.e. in a perforating gun assembly, the phasing angle between collections may be the same). Alternatively, angle $\theta_2$ may differ between different collections of shaped charges.

Preferably the perforating gun assembly also comprises a housing, and the charge carrier is disposed within the housing. The housing may comprise a substantially cylindrical member, which may define a cylindrical bore in which the charge carrier is disposed. The charge carrier may be co-axial with the housing.

In the context of this description, the term "housing" is used to refer to an outer housing or casing of the perforating gun assembly, and the term "charge carrier" is used to describe a structure to which the shaped charges are mounted (directly or indirectly) in their desired groupings and/or orientations.

Preferably, the perforating gun assembly comprises at least one internal cavity. The perforating gun assembly may therefore be at least partially hollow when the housing, charge carrier and plurality of groups of shaped charges are assembled. The charge carrier may be at least partially hollow (when loaded with a plurality of groups of shaped charges).

The inventors have appreciated that there is an unexpected benefit in using a charge carrier that is at least partially hollow in the completed perforating gun assembly, where the assembly comprises at least one group of shaped charges arranged to generate jets oriented substantially along respective axes that converge towards one another. In prior art approaches, groups of convergent charges have been disposed in solid cylindrical charge carriers. Using a charge carrier which is at least partially hollow when loaded with a plurality of groups of shaped charges provides benefits to gun survivability, and therefore offers flexibility in shaped charge placement without compromising charge weight or increasing material costs. When compared with the approach of using a charge carrier formed from a solid mandrel with machined recesses for accommodating shaped charges, an at least partially hollow charge carrier has been found to reduce survival risk.

In a preferred embodiment, the charge carrier comprises a hollow tubular member, and the tubular member comprises a plurality of apertures for accommodating the plurality of shaped charges. Preferably the apertures extend between an outer wall of the hollow tubular member and a bore defined by the hollow tubular member. The apertures may be oriented with axes corresponding to the desired axes of their respective shaped charges (i.e., the apertures may define the orientation of their respective shaped charges). Thus at least some of the apertures may be oriented with their axes at angles inclined to a plane which is perpendicular to the longitudinal axis of the charge carrier.

Preferably the apertures are arranged in at least two groups rotationally offset or phased around the longitudinal axis of the charge carrier. One or more groups of apertures may be arranged in a line parallel to the longitudinal axis of the charge carrier. Preferably each group of shaped charges is arranged in a line parallel to the longitudinal axis of the charge carrier.

The apertures may be laser cut. Alternatively, or in addition, the apertures may be machined.

Preferably, a housing of the perforating gun assembly comprises scallops corresponding to positions of the shaped charges and/or apertures.

Embodiments of the invention may comprise a charge carrier of a different form. For example, the charge carrier may comprise a solid substantially cylindrical mandrel, which may comprise machined recesses. Alternatively, or in addition, the charge carrier may comprise a chassis or frame, which may be provided with mounting points for the plurality of groups of shaped charges.

Other methods may be used to form a charge carrier in accordance with certain embodiments of the invention, including but not limited to machining, casting, or moulding of tubes or adapters, or combinations of the above-referenced techniques.

According to a second aspect of the invention, there is provided a perforating gun assembly comprising:

a charge carrier having a longitudinal axis;

a plurality of groups of shaped charges disposed on the charge carrier, wherein at least two shaped charges within each group are arranged to generate jets oriented substantially along respective axes that converge towards one another;

wherein at least two groups of shaped charges are intermeshed or interlaced in a longitudinal direction of the charge carrier.

Embodiments of the second aspect of the invention may include one or more features of the first aspect of the invention or its embodiments, or vice versa.

According to a third aspect of the invention, there is provided a perforating gun assembly comprising:

a charge carrier having a longitudinal axis;

a plurality of groups of shaped charges disposed on the charge carrier, wherein at least two shaped charges within each group are arranged to generate jets oriented substantially along respective axes that converge towards one another;

wherein a first group of shaped charges comprises charges arranged over a first axial portion of the charge carrier;

wherein a second group of charges comprises charges arranged over a second axial portion of the charge carrier;

and wherein the first and second axial portions overlap in a longitudinal direction of the charge carrier.

Embodiments of the third aspect of the invention may include one or more features of the first or second aspects of the invention or their embodiments, or vice versa.

According to a fourth aspect of the invention, there is provided a method of forming perforations in a subterranean wellbore, the method comprising:

providing a perforating gun assembly in a wellbore, the wellbore having a longitudinal axis;

detonating a first group of shaped charges of the perforating gun assembly to generate jets oriented substantially along respective axes that converge towards one another and interact to form a first perforation channel; and detonating a second group of shaped charges of the perforating gun assembly to generate jets oriented substantially along respective axes that converge towards one another and interact to form a second perforation channel;

wherein the first and second perforation channels overlap one another in a longitudinal direction of the wellbore.

The first and second perforation channels may be intersected by a plane perpendicular to the longitudinal direction of the wellbore. Therefore a plane which traverses the wellbore extends through the first and second perforation channels.

One or more of the groups of shaped charges may be arranged in a line parallel to the longitudinal axis of the wellbore. Preferably each group of shaped charges is arranged in a line parallel to the longitudinal axis of the wellbore.

The first and/or second perforation channels may have a major diameter substantially parallel to the longitudinal axis of the wellbore.

Preferably, the first and second perforation channels are rotationally offset or phased around the longitudinal axis of the wellbore.

The method may comprise detonating a third group of shaped charges of the perforating gun assembly to generate jets oriented substantially along respective axes that converge towards one another and interact to form a third perforation channel. The third perforation channel may overlap at least one of the first and/or second perforation channels in a longitudinal direction of the wellbore.

The method may comprise detonating a first collection of shaped charges of the perforating gun assembly, the first collection comprising N groups of shaped charges arranged to generate jets oriented substantially along respective axes that converge towards one another and interact to form N perforation channels; and detonating a second collection of shaped charges of the perforating gun assembly, the second collection comprising M groups of shaped charges arranged to generate jets oriented substantially along respective axes that converge towards one another and interact to form M perforation channels The overlapping perforation channels may be intersected by a plane perpendicular to the longitudinal direction of the wellbore. Therefore a plane which traverses the wellbore extends through the overlapping perforation channels.

The N perforation channels may be rotationally offset or phased around the longitudinal axis of the wellbore by 360/N degrees.

In one example, the method comprises detonating first and second groups of shaped charges to form first and second perforation channels which overlap one another and are rotationally offset by 180 degrees. In this example, the first and second perforation channels may have first and second major diameters oriented substantially in the same plane.

Using convergent shaped charges to form an arrangement of perforation channels that overlap longitudinally in the wellbore has the unexpected benefit of significantly reducing a geometrical flow resistance which may be manifested in conventional convergent charge perforation methodologies such as those described in U.S. Pat. No. 7,303,017, U.S. Pat. No. 7,172,023. The relatively large spacing required between the adjacent charge groups in U.S. Pat. No. 7,303,017, U.S. Pat. No. 7,172,023 may be avoided to result in reduced flow convergence and improved production flow.

The method of this aspect of the invention has benefits in hydraulic fracturing applications. The perforation channels formed by the inventive method are more closely aligned which aids fracture growth and placement control, as fracture initiation points are closely aligned.

An additional unexpected benefit is improved gun survivability as a result of the overlapping, and optional phasing, of groups of convergent shaped charges. The intermeshing of charges promotes the distribution and dissipation of shock wave forces through the perforating gun assembly, and increases the integrity of the perforating gun assembly and tool string without compromises regarding charge placement, charge capacity, or material and manufacturing costs.

Embodiments of the fourth aspect of the invention may include one or more features of the first to third aspects of the invention or their embodiments, or vice versa.

According to a fifth aspect of the invention, there is provided a method of performing a fracturing operation in a subterranean formation, the method comprising:

providing a perforating gun assembly in a wellbore, the wellbore having a longitudinal axis;

detonating a first group of shaped charges of the perforating gun assembly to generate jets oriented substantially along respective axes that converge towards one another and interact to form a first perforation channel; and detonating a second group of shaped charges of the perforating gun assembly to generate jets oriented substantially along respective axes that converge towards one another and interact to form a second perforation channel;

wherein the first and second perforation channels overlap one another in a longitudinal direction of the wellbore;

initiating one or more fractures from the first and/or second perforation channels.

Embodiments of the fourth aspect of the invention may include one or more features of the first to third aspects of the invention or their embodiments, or vice versa.

As noted above, the inventors have appreciated that there is an unexpected benefit in using a charge carrier that is at least partially hollow in the completed perforating gun assembly, where the assembly comprises at least one group of shaped charges arranged to generate jets oriented substantially along respective axes that converge towards one another. Therefore according to a sixth aspect of the invention, there is provided a perforating gun assembly comprising:

a charge carrier having a longitudinal axis;

at least one group of shaped charges disposed on the charge carrier, wherein at least two shaped charges within each group are arranged to generate jets oriented substantially along respective axes that converge towards one another;

wherein the charge carrier comprises a substantially hollow tubular member.

Preferably, the tubular member comprises a plurality of apertures for accommodating the plurality of shaped charges. Preferably the apertures extend between an outer wall of the hollow tubular member and a bore defined by the hollow tubular member. The apertures may be oriented with axes corresponding to the desired axes of their respective shaped charges (i.e., the apertures may define the orientation of their respective shaped charges). Thus at least some of the apertures may be oriented with their axes at angles inclined to a plane which is perpendicular to the longitudinal axis of the charge carrier.

Preferably the apertures are arranged in at least two groups rotationally offset or phased around the longitudinal axis of the charge carrier. One or more groups of apertures may be arranged in a line parallel to the longitudinal axis of the charge carrier. Preferably each group of shaped charges is arranged in a line parallel to the longitudinal axis of the charge carrier.

The apertures may be laser cut. Alternatively, or in addition, the apertures may be machined.

Preferably, a housing of the perforating gun assembly comprises scallops corresponding to positions of the shaped charges and/or apertures.

Embodiments of the sixth aspect of the invention may include one or more features of the first to fifth aspects of the invention or their embodiments, or vice versa.

According to a seventh aspect of the invention, there is provided a toolstring or downhole tool forming perforations in a subterranean wellbore, the toolstring or downhole tool comprising a perforating gun assembly according to any of the first to third or fifth aspects of the invention or their embodiments.

According to a further aspect of the invention, there is provided a perforating gun assembly substantially as described herein with reference to FIGS. 1A and 1B of the drawings.

According to a further aspect of the invention, there is provided a method of performing a perforation operation substantially as described herein with reference to FIG. 2 of the drawings.

According to a further aspect of the invention, there is provided a perforating gun assembly substantially as described herein with reference to FIG. 3 of the drawings.

According to a further aspect of the invention, there is provided a perforating gun assembly substantially as described herein with reference to FIG. 5 of the drawings.

BRIEF DESCRIPTION OF THE DRAWINGS

There will now be described, by way of example only, a various embodiments of the invention with reference to the drawings, of which.

DETAILED DESCRIPTION OF PREFERRED EMBODIMENTS

Figure 1A:
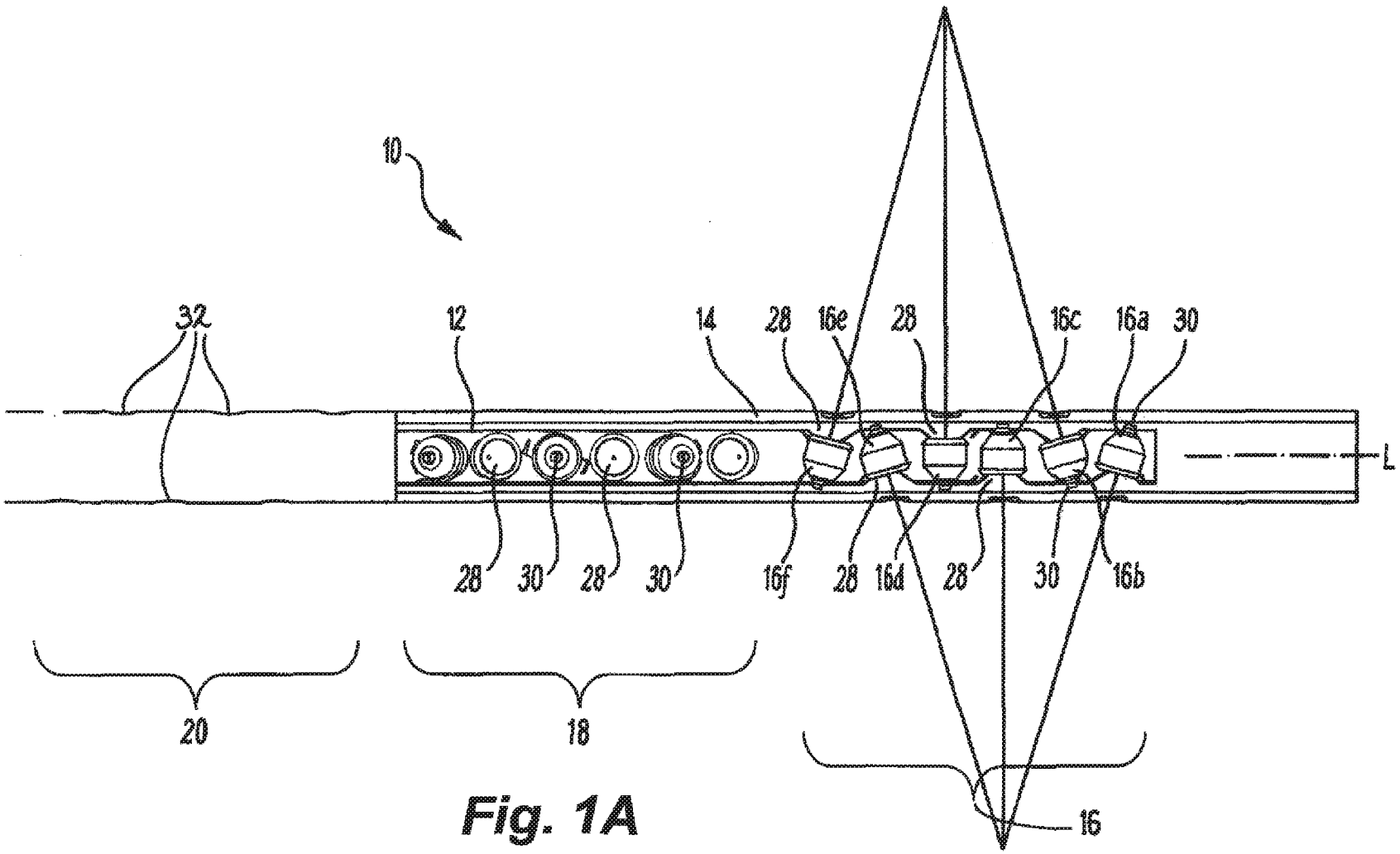
FIG. 1A is a sectional view of a perforating gun assembly in accordance with a first embodiment of the invention.
Figure 1B:
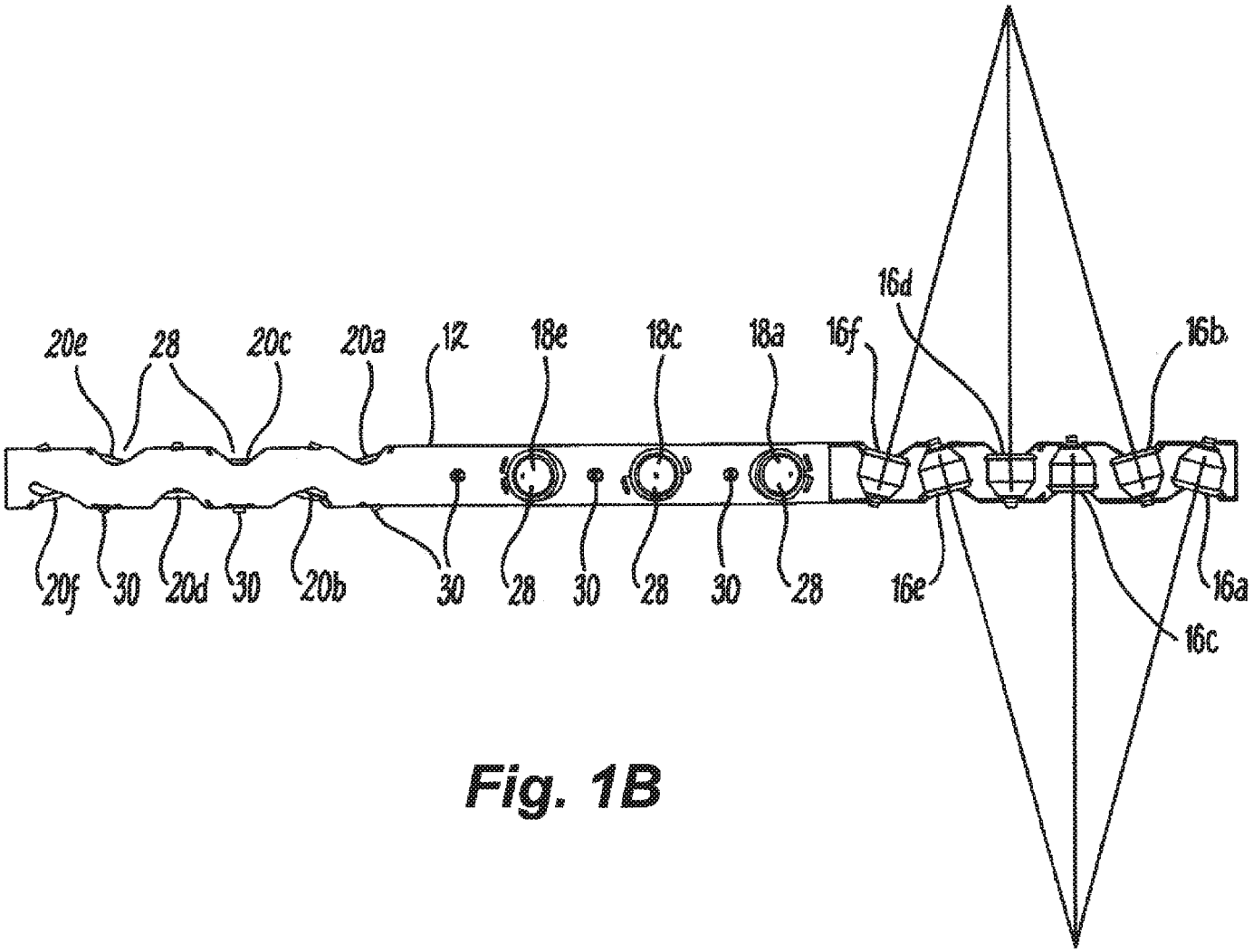
FIG. 1B is a sectional view of a charge carrier of the perforating gun assembly in the embodiment of FIG. 1A.

Referring firstly to FIG. 1A, there is shown schematically a perforating gun assembly, generally depicted at 10. The perforating gun assembly 10 is shown in part-sectional view to reveal internal components. FIG. 1B shows schematically a charge carrier 12 which forms a part of the perforating assembly 10, again in part-sectional view to reveal internal components.

The perforating gun 10 comprises a housing 14, which forms a casing for the internal components of the gun assembly 10. The housing 14 is a substantially cylindrical hollow tube, with an internal bore sized to receive and accommodate charge carrier 12.

Charge carrier 12 functions to support a number of shaped charges 16*a* to 16*f*, 18*a* to 18*f*, and 20*a* to 20*f*. The shaped charges are ballistic elements as are known in the field of wellbore perforation and hydraulic fracturing. Each includes a housing, a liner, and a quantity of explosives between the housing and the liner. On detonation the shaped charges generate a high pressure stream of particles referred to as a jet, The jet direction depends on the orientation of the shaped charge within the gun assembly.

The charge carrier 12 is a substantially cylindrical hollow tube of unitary construction which extends over an axial length of the gun assembly. Arranged over its length are a number of apertures 28, which extend from the outer wall of the charge carrier to a bore defined by the charge carrier. Each aperture 28 is sized and shaped to receive a shaped charge in its desired orientation. Corresponding mounting holes 30 are located diametrically opposite the apertures 28 and provide a fixing point for the shaped charge in its desired orientation.

In this embodiment, the apertures 28 and holes 30 are laser cut holes formed in the wall of the charge carrier. The aperture 28 and its corresponding mounting hole enable the shaped charge to be mounted at a fixed angle with respect to a plane perpendicular to the longitudinal axis L of the charge carrier. The orientation of the apertures and the mounting holes together determines the orientation of the shaped charges, and consequently the direction of jets resulting from the detonation of the shaped charges and the nature of the perforations formed.

The shaped charges of the gun assembly 10 are arranged in collections 16, 18 and 20. Each collection comprises multiple charges and extends over an axial length of the charge carrier, and the collections 16, 18 and 20 are axially separated on the charge carrier. Within each collection, the shaped charges are arranged in functional groups of converging charges. In collection 16, a first group of shaped charges comprises shaped charge 16*a*, 16*c* and 16*e*, all of which are oriented in a line parallel to the longitudinal axis such that they are in the same plane parallel to the longitudinal axis. Two of the charges, 16*a* and 16*e*, are oriented with their axes at angles inclined to a plane which is perpendicular to the longitudinal axis of the charge carrier such that they converge towards one another. In addition, the axis of charge 16*c* is oriented towards the point of intersection of the axes of charges 16*a* and 16*e*. The three shaped charges in the group are therefore oriented to converge to the same point in the formation.

A second group of shaped charges is formed from charges 16*b*, 16*d*, and 16*f* all of which are oriented in a line parallel to the longitudinal axis such that they are in a plane parallel to the longitudinal axis. The plane of the second group is rotationally offset or phased with respect to the first group. In this case the phasing angle $\theta_1$ is 180 degrees, so that the first and second groups are oriented in the same plane but in opposing directions. Charges 16*b* and 16*f* are oriented with their axes at angles inclined to a plane which is perpendicular to the longitudinal axis of the charge carrier such that they converge towards one another. In addition, the axis of charge 16*d* is oriented towards the point of intersection of the axes of charges 16*a* and 16*e*. The three shaped charges in the second group are therefore oriented to converge to the same point in the formation.

The first and second groups of charges are intermeshed or interlaced such that they overlap over the axial direction of the charge carrier; each group extends over an axial portion which overlaps a perpendicular plane. This configuration of converging charge groups has surprising advantages relating to gun survival and flow geometry, as will be described below.

Collections of charges 18 and 20 are similar to the collection 16, and will not be described in detail in the interests of brevity. Each comprises two groups of convergent shaped charges (18*a*, 18*c*, 18*e* and 18*b*, 18*d*, 18*f*; 20*a*, 20*c*, 20*e* and 20*b*, 20*d*, 20*f* respectively) which are intermeshed or interlaced such that they overlap over the axial direction of the charge carrier. The two groups are phased by an angle $\theta_1$ of 180 degrees. In addition, collection 18 is rotationally offset or phased with respect to the collection 16, in this case by an angle $\theta_2$ of 90 degrees. In addition, collection 20 is rotationally offset or phased with respect to the collection 18 by an additional angle $\theta_2$ of 90 degrees.

The shaped charges, arranged in functional groups in the charge carrier as described above, are loaded into the perforating gun assembly by locating and securing the charge carrier 12 into the housing 14. The housing 14 also comprises scallops 32 distributed over the surface of the housing in locations which correspond to the positions and orientations of the shaped charges in the assembled gun.

The perforating gun assembly also contains a detonation system which in this case comprises a detonation cord (not shown) which runs along the length of the bore of the charge carrier 12, connecting the shaped charges in series. Other detonation arrangements, such as those that use different detonation sequences or timing delays, may be used in alternative embodiments and are within the scope of the invention.

A method of use of an embodiment of the invention will now be described with reference to FIGS. 1A, 1B and 2.

Figure 2:
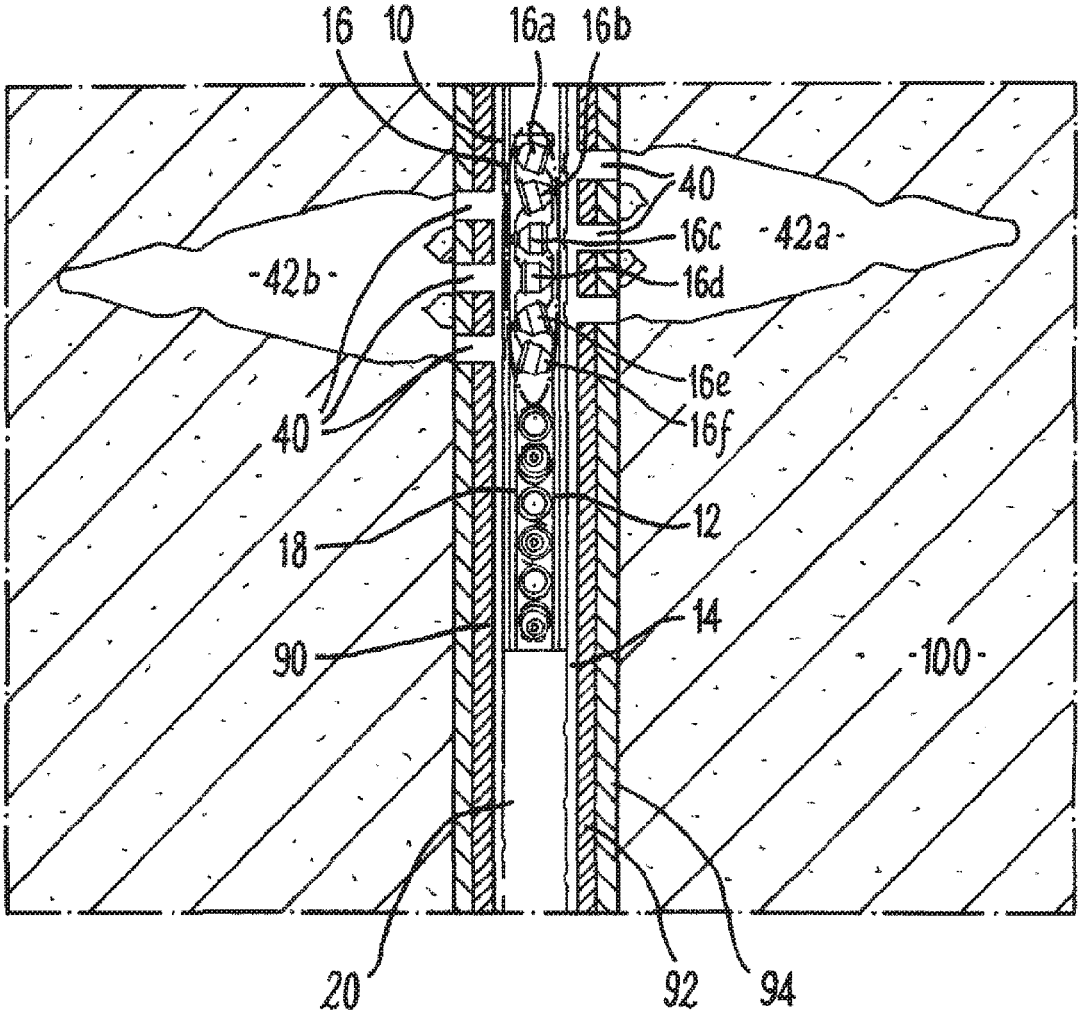
FIG. 2 is a schematic representation of a wellbore traversing a subterranean formation, with perforating channels formed according to an embodiment of the invention.

FIG. 2 shows schematically the perforating gun assembly 10 in situ in a wellbore 90 in a subterranean formation 100. The perforating gun assembly 10 has been run to the required downhole location by a suitable conveyance such as electric wireline. When in the required depth, the perforating gun assembly is located against the wellbore casing and the detonation sequence is activated. The shaped charges detonate in the sequence 16*a* to 16*f*, 18*a* to 18*f*, and 20*a* to 20*f*, to create perforations 40 which penetrate through the casing 92, cement 94 and into the formation 100. The time between the detonation of adjacent shaped charges is very small (of the order of a few microseconds), and therefore the perforation channels are created near simultaneously during the detonation sequence, and the time periods over which the first and second perforation channels are formed overlap one another.

FIG. 2 shows schematically the wellbore and formation subsequent to detonation of the shaped charges 16*a* to 16*f*. In the formation, the individual perforations 40 converge towards one another and interact to form perforation channels 42*a*, 42*b*. The perforation channels have a major diameter substantially parallel to the longitudinal axis of the wellbore 90, and overlap in a longitudinal direction of the wellbore 90.

Subsequent detonation of the shaped charges of collection 18 will form a similar pair of overlapping perforation channels, phased at 90 degrees with respect to channels 42*a*, 42*b*. Detonation of the shaped charges of collection 20 will form another pair of overlapping perforation channels, phased at 90 degrees with respect to the channels of collection 18.

Using convergent shaped charges to form an arrangement of perforation channels that overlap longitudinally in the wellbore has the unexpected benefit of significantly reducing a geometrical flow resistance which may be manifested in conventional convergent charge perforation methodologies such as those described in U.S. Pat. No. 7,303,017, U.S. Pat. No. 7,172,023. The radial connection of the perforation channels to the wellbore is improved by providing channels which are distributed radially (or phased) around the wellbore, with closer axial proximity and alignment.

Certain embodiments of the invention has been shown to benefit the Productivity Index of a wellbore (i.e. the ability of a reservoir to deliver fluids to the wellbore), particularly for reservoir conditions in which vertical permeability kv is less than horizontal permeability kh. Table 1 presents data obtained from CFD modelling of production flow for a reservoir with a ratio kv/kh of 0.1, which is a typical value for a hydrocarbon-bearing formation.

Figure 6D:
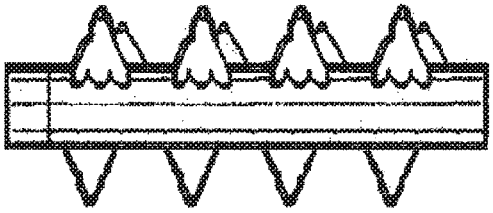
FIGS. 6B, 6C and 6D are schematic representations of perforation flow geometries in accordance with embodiments of the invention.
Figure 6C:
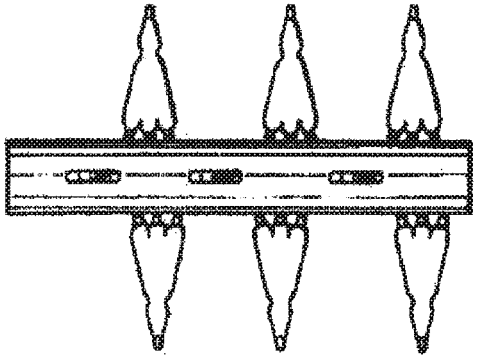
Figure 6C:
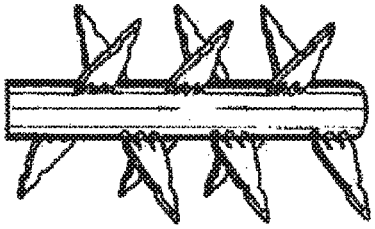
Figure 6B:
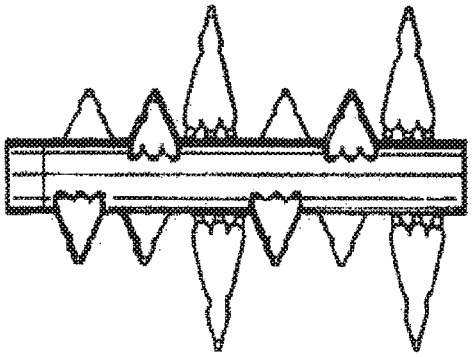
Figure 6B:
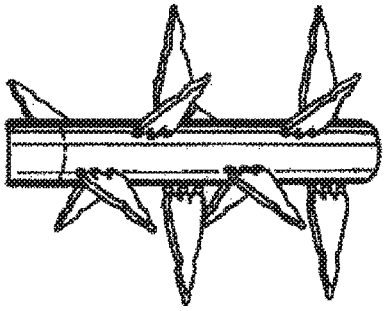
Figure 6A:
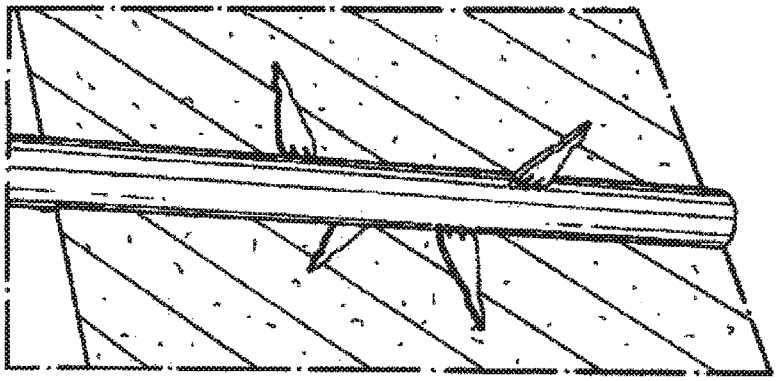
FIG. 6A is a schematic representation of a non-overlapping perforation flow geometry.

Flow rate was calculated for each of the geometries shown in FIGS. 6A to 6C, and compared to a flow rate for a conventional single shot perforation geometry with an equivalent shot density to each modelled geometry. This enabled a flow rate increase to be calculated. In all cases, the pressure differential (P Diff), crushed zone permeability divided by base rock permeability (k_cz/k), and rock permeability were the same.

FIG. 6A represents a perforation geometry in which first and second groups of charges are phased at 90 degrees to one another and are spatially separated rather than being overlapped or intermeshed.

FIG. 6B shows an overlapped perforation geometry in accordance with an embodiment of the invention, where first and second groups of charges are phased at 180 degrees to one another in an opposing configuration, and collections of charges are phased at 60 degrees to one another.

FIG. 6C shows an overlapped perforation geometry in accordance with an embodiment of the invention, where first and second groups of charges are phased at 180 degrees to one another in an opposing configuration, and collections of charges are phased at 90 degrees to one another.

TABLE 1

| Drawing | Perforation Geometry, 2 ft (~0.6 m) entry | P Diff (bar) | k_cz/k | kv/kh | Rock Perm (mD) | Diff (%) |
|---|---|---|---|---|---|---|
| FIG. 6A | Non-overlapped 90 Deg phase | 60 | 0.35% | 0.1 | 100 | 43% |
| FIG. 6B | Opposing Overlapped 60 Deg Phase | 60 | 0.35% | 0.1 | 100 | 49% |
| FIG. 6C | Opposing Overlapped 90 Deg Phase | 60 | 0.35% | 0.1 | 100 | 49% |

The data shows that while the non-overlapped 90 degree phase geometry of FIG. 6A resulted in an improvement in flow rate of 43% compared with its single-shot base model, the perforation geometries of FIGS. 6B and 6C in accordance with the invention led to an improvement of 49% over their corresponding single-shot base models. This additional 6% increase in productivity index is attributable to the improved connectivity provided by the axially overlapping configurations.

FIG. 6D shows an overlapped perforation geometry in accordance with an embodiment of the invention, where a third perforation channel overlaps at least one of the first and/or second perforation channels in a longitudinal direction of the wellbore.

The invention also has benefits in hydraulic fracturing applications: the perforation channels are more closely aligned which aids fracture growth and placement control, as fracture initiation points are closely aligned.

An additional unexpected benefit is significantly improved gun survivability as a result of the overlapping groups of convergent shaped charges. The intermeshing or interlacing of charges promotes the distribution and dissipation of shock wave forces through the perforating gun assembly, and increases the integrity of the perforating gun assembly and tool string without compromises regarding charge placement, charge capacity, or material and manufacturing costs.

The benefits to survival risk are illustrated in the following examples, described with reference to FIGS. 3 and 4, in which perforating gun assemblies were tested with and without the intermeshing or interlacing characteristic of an aspect of the invention.

EXAMPLE

A perforating gun assembly was formed according to the principles of the invention and testing according to industry standard API surface detonation tests. The gun assembly length was 6 ft (1.83 m), and the gun outer diameter was 3.125" (7.94 cm). The charge carrier was configured with two collections of shaped charges, each comprising two groups of three converging charges. The phasing angle between groups of shaped charges in a collection (angle $\theta_1$) was 60 degrees. The phasing angle between collections of shaped charges (angle $\theta_2$) was 180 degrees. The first and second shaped charge groups in each collection were intermeshed.

The charge carrier was loaded with its specified maximum charge weight of 22.7 g for each shaped charge. The carrier was loaded into the gun casing and the end subs were made up to seal the assembly. A fuse head and detonator was attached to make the gun ready for detonation.

The perforating gun was placed into a ground pit and secured. The surface detonation cables were made up and the pit was filled with water for blast containment.

The gun assembly was detonated and removed to be inspected for damage, splitting and gun swell.

Figure 3:
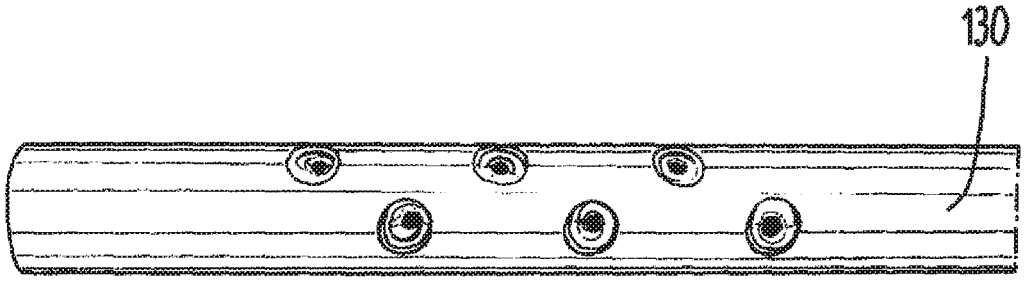
FIG. 3 is an image of an example perforating gun assembly in accordance with a second embodiment of the invention, shown after detonation in a survivability test.

FIG. 3 is a photograph of the gun assembly 130 after testing. It shows that the assembly remains intact, with no issues relating to damage, splitting or gun swell.

A collapse test was also performed, revealing that the failure point of the scalloped body on the test article occurred at approximately 23,000 psi (about 159,000 kPa).

COMPARATIVE EXAMPLE

A perforating gun assembly was formed with the same gun assembly length and diameter as the Example above: 6 ft (1.83 m) and 3.125" (7.94 cm) respectively. The charge carrier was configured with convergent groups of shaped charges, each comprising two groups of three converging charges. The groups of charged are axially separated (unmeshed). The phasing angle between groups of shaped charges (angle $\theta_1$) was 60 degrees.

The charge carrier was loaded with its specified maximum charge weight of 22.7 g for each shaped charge. The carrier was loaded into the gun casing and the end subs were made up to seal the assembly. A fuse head and detonator was attached to make the gun ready for detonation.

The perforating gun was placed into a ground pit and secured. The surface detonation cables were made up and the pit was filled with water for blast containment.

The gun assembly was detonated and removed to be inspected for damage, splitting and gun swell.

Figure 4:
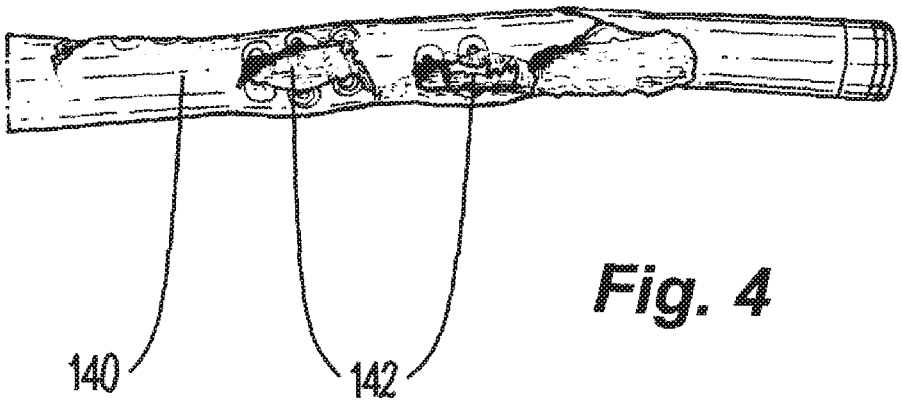
FIG. 4 is a comparative image of an example perforating gun assembly according to the prior art, shown after detonation in a survivability test.

FIG. 4 is a photograph of the gun assembly 140 after testing. It shows that the assembly is severely damaged, with significant splitting between charges within a convergent group, shown at 142, and unacceptable gun swell and distortion.

A collapse test was also performed, revealing that the failure point of the scalloped body on the test article occurred at approximately 20,000 psi (about 138,000 kPa).

The tests performed reveal that the perforating gun assembly according to an embodiment of the invention with intermeshed groups of converging charges outperformed an equivalent specification perforating gun assembly in industry standard gun survivability tests and collapse tests. Significantly, the perforating gun assembly according to an embodiment of the invention passed the industry standard gun survivability test whereas the non-intermeshed perforating gun failed the gun survivability test.

The surprising degree of improvement to gun survivability can be attributed to the spreading of the mechanical load exerted on the gun casing when detonation of the shaped charges occurs. This is due to the separation of scallop placement and the resulting axial load transition.

The above-described embodiments of the invention comprise a charge carrier formed from a substantially cylindrical hollow tube of unitary construction. The inventors have appreciated that in convergent charge perforating assemblies, there is an unexpected benefit in using a charge carrier that is at least partially hollow in the completed perforating gun assembly. Using a charge carrier which is at least partially hollow when loaded with a plurality of groups of shaped charges provides benefits to gun survivability, and therefore offers flexibility in shaped charge placement without compromising charge weight or increasing material costs. When compared with the approach of using a charge carrier formed from a solid mandrel with machined recesses for accommodating shaped charges, an at least partially hollow charge carrier has been found to reduce survival risk.

However, alternative embodiments of the invention may comprise a charge carrier of a different form. For example, the charge carrier may comprise a solid substantially cylindrical mandrel with machined recesses.

Figure 5:
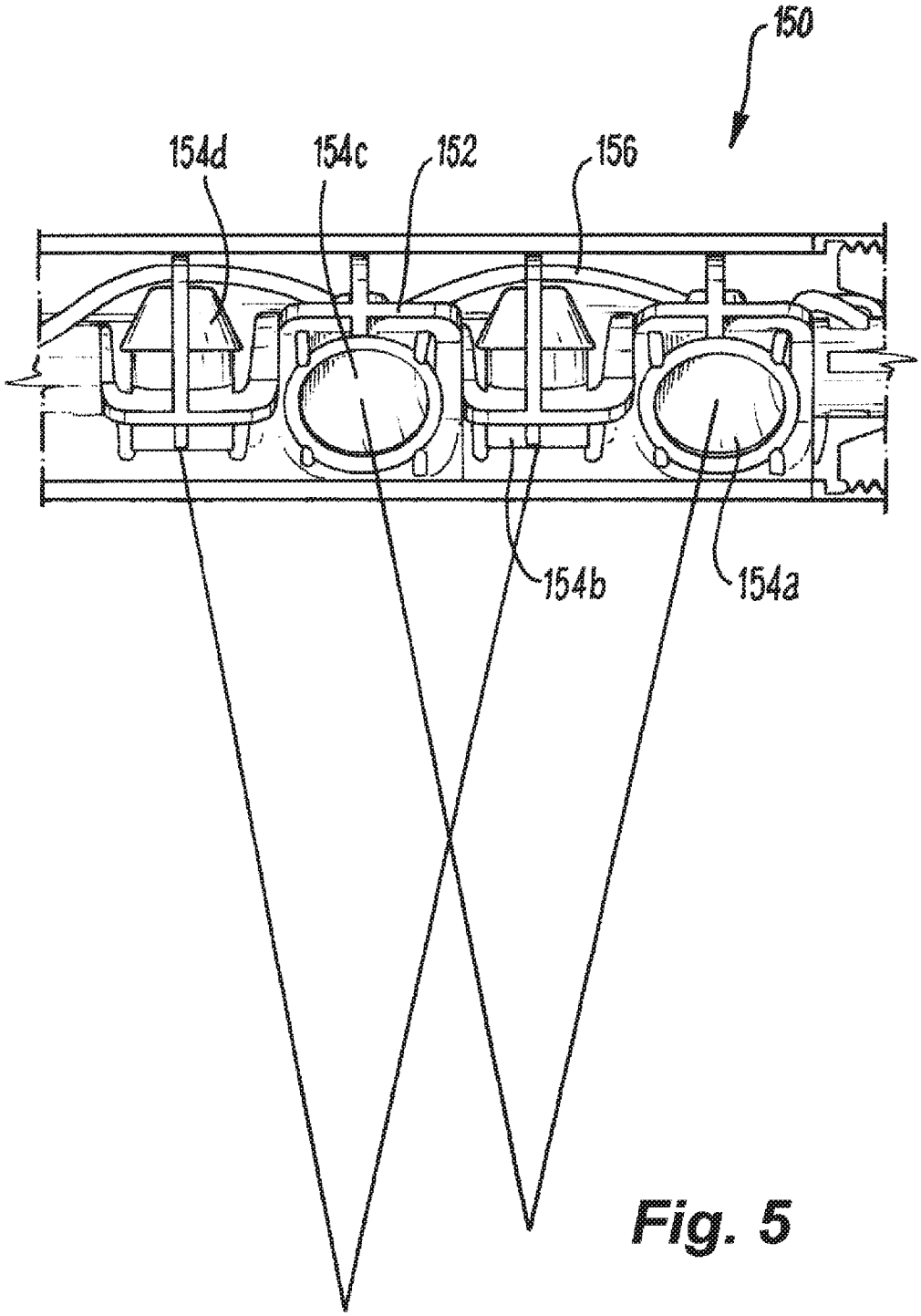
FIG. 5 is a sectional view of a perforating gun assembly in accordance with a third embodiment of the invention.

FIG. 5 is a schematic view of a part of a perforating gun assembly according to an alternative embodiment of the invention. The assembly, generally depicted at 150, is similar to the assembly 10 of FIGS. 1A and 1B, and its principles of operation will be understood from those Figures and their accompanying description. However, the assembly 150 differs in several respects which will be described below.

The assembly 150 comprises a charge carrier in the form of a chassis or frame 152, provided with mounting points for shaped charges 154*a* to 154*d*. The frame 152 comprises a network of metal support elements which define recesses in which the shaped charges are located. The frame 152 also supports the path of the detonation cord 156 which connects the shaped charges in series.

In this embodiment, the shaped charges 154*a* to 154*d* are arranged in a collection comprising two groups of two converging charges. The first group comprises charges 154*a* and 154*c*, and the second group comprises charge 154*b* and 154*d*. The first and second groups are intermeshed axially along the charge carrier, and are phased with respect to one another by an angle $\theta_1$ of 60 degrees. The assembly comprises additional collections of charges (not shown) axially separated from the first collection, which may be phased by an angle $\theta_2$. When detonated, the groups of shaped charges form perforation channels which overlap in an axial direction of the charge carrier.

Other suitable shapes, forms and construction methods may be used for the charge carrier structure. For example, in further alternatives to the described embodiments, the charge carrier may comprise support elements formed from polymeric (e.g. high strength plastics) or composite materials. Methods used to manufacture a charge carrier in accordance with certain embodiments of the invention include but are not limited to machining, casting, or moulding, or combinations of the above-referenced techniques.

It will be appreciated that in other embodiments of the invention different configurations of convergent charge groups, collections and phasing angles $\theta_1$ and/or $\theta_2$ may be used. For example, a collection may comprise N groups of shaped charges arranged to generate jets oriented substantially along respective axes that converge towards one another and create perforations which interact to form N perforation channels. The number of collections of shaped charges in an assembly may be varied according to the application, and is not limited to the embodiments described herein. Phasing angles may be selected according to the application, well geometry, or formation conditions.

Further alternatives to the described embodiments are envisaged within the scope of the invention. For example, although the drawings illustrate shaped charges which extend across the central axis of the charge carrier, and which have a detonation cord that follows the path required to pass around the shaped charges, in an alternative embodiment the charges may be arranged to fit around a detonation cord which runs axially in the tool. In particular, a central detonation cord may be used in some embodiments, and/or the shaped charges arranged in a sector of the cross section of the charge carrier on the outside of the detonation cord. Such a configuration may be particularly applicable to an assembly of relatively large diameter (e.g. 7 inches or 17.8 cm)).

Although the above-described embodiments use shaped charges of the same type and weight, in alternative embodiments, different charge types and/or weights may be used within the same collection, and/or within the same charge group. For example, where a group consists of three or more charges, one or more inner charges in the group may be of a different (greater of lesser) charge weight than one or more outer charges.

The invention a perforating gun assembly and methods of use in forming perforations hydraulic fracturing. The perforating gun assembly comprises a charge carrier having a longitudinal axis and a plurality of groups of shaped charges disposed on the charge carrier. At least two shaped charges within each group are arranged to generate jets oriented substantially along respective axes that converge towards one another. At least two groups of shaped charges overlap one another in a longitudinal direction of the charge carrier, or are intermeshed or interlaced in a longitudinal direction of the charge carrier. In embodiments of the invention the assembly may comprise at least two groups of shaped charges rotationally offset or phased around the longitudinal axis of the charge carrier, and in preferred embodiments the perforating gun assembly comprises a plurality of phased collections of shaped charges comprising multiple groups.

Various modifications to the above-described embodiments may be made within the scope of the invention, and the invention extends to combinations of features other than those expressly claimed herein.

The invention claimed is:

1. A perforating gun assembly comprising:

a charge carrier having a longitudinal axis;

a plurality of groups of shaped charges disposed on the charge carrier, wherein at least two shaped charges within each group are arranged to generate jets oriented substantially along respective axes that converge towards one another and interact to form a perforation channel;

wherein at least two groups of the plurality of groups of shaped charges are positioned on the charge such that they form perforation channels that overlap one another in a longitudinal direction of the charge carrier.

2. The assembly according to claim 1, wherein the at least two groups of shaped charges are intermeshed or interlaced in a longitudinal direction of the charge carrier.

3. The assembly according to claim 1, wherein the at least two groups of the plurality of groups of shaped charges comprises:

a first group of shaped charges comprising charges arranged over a first axial portion of the charge carrier; and a second group of shaped charges comprising charges arranged over a second axial portion of the charge carrier;

wherein the first and second axial portions overlap in a longitudinal direction of the charge carrier.

4. The assembly according to claim 1, wherein the at least two groups of the plurality of groups of shaped charges are rotationally offset or phased around the longitudinal axis of the charge carrier.

5. The assembly according to claim 1, wherein one or both of the at least two groups of the plurality of groups of shaped charges are arranged in a line parallel to the longitudinal axis of the charge carrier.

6. The assembly according to claim 5, wherein each group of shaped charges is arranged in a line parallel to the longitudinal axis of the charge carrier.

7. The assembly according to claim 1, wherein the assembly comprises a collection comprising first and second groups of the plurality of groups of shaped charges arranged to form first and second perforation channels, respectively, such that the first and second perforation channels are intersected by a plane oriented perpendicular to the longitudinal direction of the wellbore, and wherein the first and second perforation channels are rotationally offset by 180 degrees.

8. The assembly according to claim 1, wherein the assembly comprises a collection comprising a first and a second group of the plurality of groups of shaped charges, arranged to form first and second perforation channels, respectively, such that the first and second perforation channels are intersected by a plane perpendicular to the longitudinal direction of the wellbore, and wherein the first and second perforation channels are rotationally offset by 90 degrees.

9. The assembly according to claim 1, wherein the at least two groups of the plurality of groups of shaped charges form a first collection, wherein at least two further groups of the plurality of groups of shaped charges form a second collection, and wherein the at least two further groups of the second collection comprise at least two shaped charges arranged to generate jets oriented substantially along respective axes that converge towards one another and interact to form a perforation channel.

10. The assembly according to claim 9, wherein each collection comprises at least two groups of the plurality of groups of shaped charges that are positioned on the charge carrier such that they form perforation channels that overlap one another in a longitudinal direction of the charge carrier.

11. The assembly according to claim 9, wherein the first and second collections of shaped charges are axially separated along the charge carrier.

12. The assembly according to claim 9, wherein the first and second collections of shaped charges are rotationally offset or phased around the longitudinal axis of the charge carrier.

13. The assembly according to claim 1, wherein the charge carrier is disposed within a housing, and wherein the charge carrier is at least partially hollow.

14. The assembly according to claim 13, wherein charge carrier comprises a hollow tubular member.

15. The assembly according to claim 14, wherein the tubular member comprises a plurality of apertures or holes for accommodating the plurality of shaped charges.

16. The assembly according to claim 15, wherein the apertures or holes are be oriented with axes corresponding to the desired axes of their respective shaped charges.

17. The assembly according to claim 13, wherein the apertures or holes are laser cut.

18. The assembly according to claim 1, wherein a housing of the perforating gun assembly comprises scallops corresponding to positions of the shaped charges.

19. The assembly according to claim 1, wherein the at least two groups of the plurality of groups of shaped charges are rotationally offset or phased around the longitudinal axis of the charge carrier, and wherein each group of shaped charges is arranged in a line parallel to the longitudinal axis of the charge carrier.

20. The assembly according to claim 1, where the assembly comprises a collection comprising first and second groups of the plurality of groups of shaped charges arranged to form first and second perforation channels, respectively, such that the first and second perforation channels are intersected by a plane perpendicular to the longitudinal direction of the wellbore, and where the first and second perforation channels are rotationally offset from one another.

21. The assembly according to claim 20, wherein the first and second perforation channels have first and second major diameters oriented substantially in the same plane.

22. A method of forming perforations in a subterranean wellbore, the method comprising:

providing a perforating gun assembly in a wellbore, the wellbore having a longitudinal axis;

detonating a first group of shaped charges of the perforating gun assembly to generate jets oriented substantially along respective axes that converge towards one another and interact to form a first perforation channel; and detonating a second group of shaped charges of the perforating gun assembly to generate jets oriented substantially along respective axes that converge towards one another and interact to form a second perforation channel;

wherein the first and second perforation channels overlap one another in a longitudinal direction of the wellbore.

23. The method according to claim 22, wherein the first and/or second perforation channels have a major diameter substantially parallel to the longitudinal axis of the wellbore.

24. The method according to claim 22, wherein the first and second perforation channels are rotationally offset or phased around the longitudinal axis of the wellbore.

25. The method according to claim 22, comprising detonating a third group of shaped charges of the perforating gun assembly to generate jets oriented substantially along respective axes that converge towards one another and interact to form a third perforation channel.

26. The method according to claim 25, wherein the third perforation channel overlaps at least one of the first and/or second perforation channels in a longitudinal direction of the wellbore.

27. The method according to claim 22, comprising detonating the first and second groups of shaped charges to form first and second perforation channels, respectively, wherein the first and second perforation channels are intersected by a plane oriented perpendicular to the longitudinal direction of the wellbore, and wherein the first and second perforation channels are rotationally offset by 180 degrees.

28. The method according to claim 22, comprising detonating the first and second groups of shaped charges to form first and second perforation channels, respectively, wherein the first and second perforation channels are intersected by a plane oriented perpendicular to the longitudinal direction of the wellbore, and wherein the first and second perforation channels are rotationally offset by 90 degrees.

29. The method according to claim 22, wherein the first group and second group of shaped charges are within a first collection of shaped charges comprising N groups of shaped charges, each shaped charge within a group arranged to generate jets oriented substantially along respective axes that converge towards one another and interact to form a perforation channel;

wherein the assembly comprises a second collection of shaped charges, the second collection comprising M further groups of shaped charges, each shaped charge within a group arranged to generate jets oriented substantially along respective axes that converge towards one another and interact to form a perforation channel;

wherein the method comprises:

detonating the first collection of shaped charges to form N perforation channels; and detonating the second collection of shaped charges to form M perforation channels.

30. The method according to claim 22, wherein the first and second perforation channels are intersected by a plane perpendicular to the longitudinal direction of the wellbore.

31. A method of performing a fracturing operation in a subterranean formation, the method comprising:

forming perforations by the method of claim 22; and initiating one or more fractures from the first and/or second perforation channels.

* * * * *